US006593684B1

(12) United States Patent
Makita et al.

(10) Patent No.: US 6,593,684 B1
(45) Date of Patent: Jul. 15, 2003

(54) SHADOW MASK FOR BRAUN TUBE

(75) Inventors: Akira Makita, Tokyo-to (JP); Takahito Aoki, Tokyo-to (JP); Nobuaki Kanayama, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 9 days.

(21) Appl. No.: 09/698,576

(22) Filed: Oct. 27, 2000

(30) Foreign Application Priority Data

Oct. 29, 1999 (JP) ..... P11-310064

(51) Int. Cl.[7] ..... H01J 29/07
(52) U.S. Cl. ..... 313/407; 313/402
(58) Field of Search ..... 313/402, 403, 313/407, 408

(56) References Cited

U.S. PATENT DOCUMENTS 5,562,783 A * 10/1996 Inoue et al. ..... 148/310
5,811,918 A * 9/1998 Van Den Berg et al. .... 313/402

FOREIGN PATENT DOCUMENTS

DE 3642205 * 1/1988

* cited by examiner

*Primary Examiner*—Ashok Patel
(74) *Attorney, Agent, or Firm*—Timothy J. Keefer; Wildman, Harrold, Allen & Dixon

(57) ABSTRACT

A shadow mask for a Braun tube is composed of an iron-based alloy plate of a low thermal expansion structure containing nickel and cobalt, and the iron-based alloy plate has a crystal grain size of more than 6.0 and less than 9.0 measured by a grain size measuring method prescribed in JIS (Japanese Industrial Standard) G0551, and 0.2% proof stress of more than 240N/mm$^2$ and less than 320N/mm$^2$.

6 Claims, 2 Drawing Sheets

SHADOW MASK FOR BRAUN TUBE

CROSS REFERENCE TO RELATED APPLICATION

This application claims the priority of Japanese patent application Serial No. 11-310064 filed on Oct. 29, 1999.

BACKGROUND OF THE INVENTION

The present invention relates to a shadow mask, especially, of a low thermal (heat) expansion type to be usable for a color Braun tube of, for example, a color television set or computer, and more particularly, to a shadow mask for a Braun tube capable of being easily press-molded at a time of manufacture and having a small spring-back after the press-molding.

A shadow mask used for a color Braun tube of such as color television or color computer is disposed to a predetermined position in the color Braun tube and formed. with a number of small holes, i.e. apertures, through which electron beams are irradiated to a fluorescent material on an inner surface of the Braun tube. In the Braun tube of this structure, since there is a possibility that a part of the electron beams emitted from an electron gun also collide with the surface of the shadow mask without passing through the apertures, the shadow mask is heat-generated through the collision of the electron beams. However, since a conventional shadow mask is formed by utilizing a low carbon steel plate having a large thermal expansion coefficient, the shadow mask thus formed was liable to cause a thermal expansion due to the heat generation through the collision of the electron beam, and hence, such phenomenon as position shifting of the aperture or shape deformation thereof was easily caused. Such phenomenon causes the position shifting of the electron beam reaching the fluorescent surface in the Braun tube, which results in color shifting of a formed image, thus providing a problem.

Incidentally, it is desired for a shadow mask to have an excellent press-moldability (workability) because the shadow mask must be press-molded in conformity with an inner shape of the Braun tube. However, since an original plate member for the shadow mask formed of the low carbon steel plate mentioned above has provided no excellent press-moldability, in the conventional technology, the shadow mask plate member just before the press-molding was annealed at a temperature of about 700–1000° C. under an oxidation-reduction atmosphere so as to improve the press-moldability. However, this annealing process poses problems such that the number of the processes of manufacturing the Braun tube is increased, plate members for the shadow masks adhere to each other during the annealing process and/or the annealing itself is unevenly performed, which result in distortion of the plate members. Such problems lead to the lowering of the manufacturing efficiency of the shadow mask and, moreover, the image display quality of the manufactured Braun tube was also deteriorated.

Furthermore, in prior art, it was intended to solve these problems by using an iron-based alloy plate as a plate member for a shadow mask, containing 30–45 weight % of nickel so as to prescribe the bearing force and expansion thereof within predetermined ranges.

However, in the prior art using such plate member for the shadow mask, a desired press-moldability could not be achieved, and moreover, no countermeasure was taken for preventing the spring back caused during the press molding process.

SUMMARY OF THE INVENTION

An object of the present invention is to substantially eliminate defects or drawbacks encountered in the prior art mentioned above and to provide a shadow mask for a Braun tube capable of further improving the press-moldability of a plate member for the shadow mask and suppressing the occurrence of the spring back as much as possible at the time of the press molding.

This and other objects can be achieved according to the present invention by providing a shadow mask for a Braun tube composed of an iron-based alloy plate of a low thermal expansion structure containing nickel and cobalt, wherein the iron-based alloy plate has a crystal grain size of more than 6.0 and less than 9.0 measured by a grain size measuring method prescribed in JIS (Japanese Industrial Standard) G0551, and 0.2% proof stress of more than 240N/mm$^2$ and less than 320N/m$^2$.

In a preferred embodiment, the crystal grain size of said iron-based alloy plate is preferably of more than 7.5 and less than 8.5 and the 0.2% proof stress thereof is preferably of more than 270N/mm$^2$ and less than 300N/mm$^2$. A maximum value of degree of integration of the respective crystal faces of the iron-based alloy plate is of 20%, which is measured by an X-ray diffraction method. The iron-based alloy plate is press-molded to a shadow mask without effecting-annealing process.

More in detail, there is provided a shadow mask for a Braun tube comprising:

a frame member;

a mask body in shape of plate made of an iron-based alloy material; and an opening portion formed to the mask body, wherein the iron-based alloy plate of a low thermal expansion structure containing nickel and cobalt, wherein the iron-based alloy plate has a crystal grain size of more than 6.0 and less than 9.0 measured by a grain size measuring method prescribed in JIS (Japanese Industrial Standard) G0551, and 0.2% proof stress of more than 240N/mm$^2$ and less than 320N/mm$^2$.

As mentioned hereinabove, according to the present invention, the thermal expansion is hardly caused even by the generation of heat due to the collision of electron beams and, hence, there is less occur hole position shifting or hole shape deformation. Therefore, any position shifting or deviation of the electron beam reaching the fluorescent surface of the Braun tube is hardly caused, and hence, color shifting or unevenness of an image can be significantly prevented from causing. Furthermore, the shadow mask manufactured by such iron-based allot plate is excellent press-moldability and the generation of the spring back at the time of press-molding can be suppressed, so that an improved manufacturing efficiency of the shadow mask can be achieved, and moreover, the image display quality of the Braun tube using such shadow mask can be further improved.

Furthermore, the anisotropy in the crystal face orientation can be made small, and hence, the anisotropy to the plastic deformability at the time of press-molding can be suppressed as much as possible, thus manufacturing the shadow mask having an excellent dimensional stability, and hence, the image display quality of the Braun tube using such shadow mask can be further improved.

Still furthermore, the number of manufacturing processes or steps can be reduced, so that problems which may be caused in the conventional annealing process will be eliminated. Therefore, the improved manufacturing efficiency of the shadow mask can be achieved, and moreover, the image display quality of the Braun tube using such shadow mask can be further improved.

The nature and further characteristic features of the present invention will be made more clear from the following descriptions made with reference to the accompanying drawings.

DESCRIPTION OF THE PREFERRED EMBODIMENT

A shadow mask for a Braun tube according to one embodiment of the present invention will be described hereunder with reference to FIGS. 1 and 2.

Figure 1:
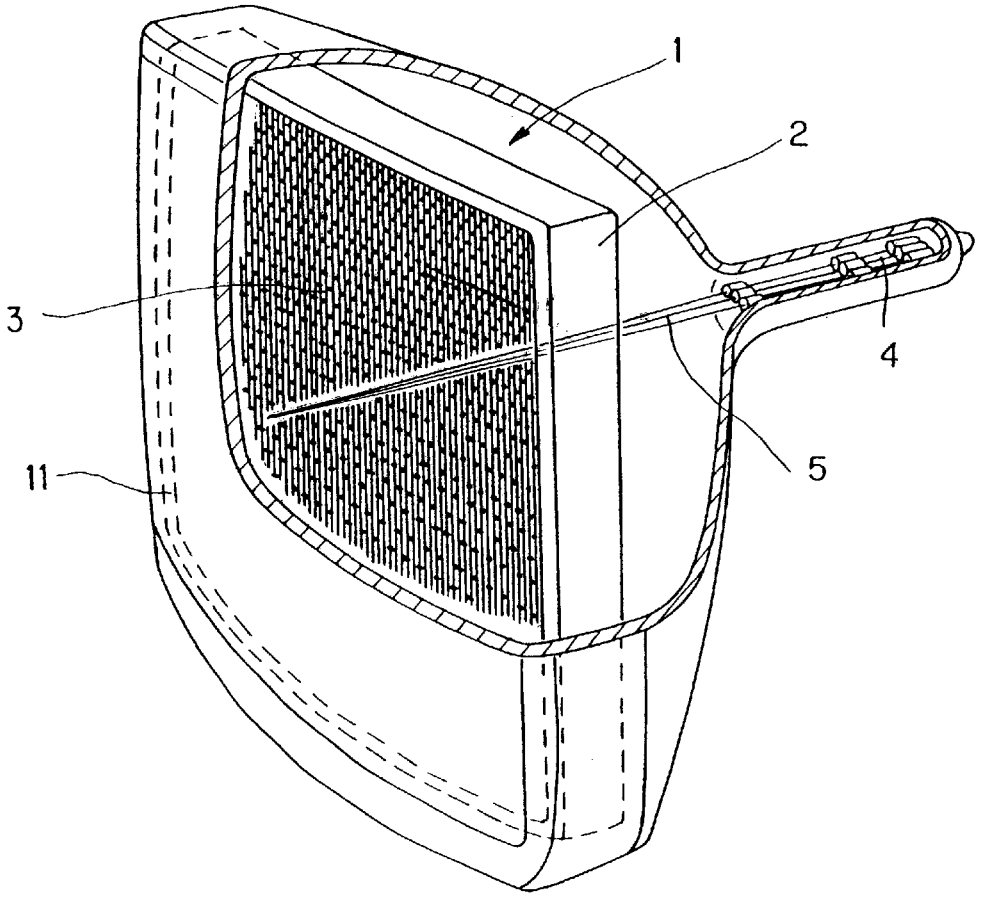
FIG. 1 is a perspective view of a Braun tube to which one embodiment of a shadow mask according to the present invention is applied.
Figure 2:
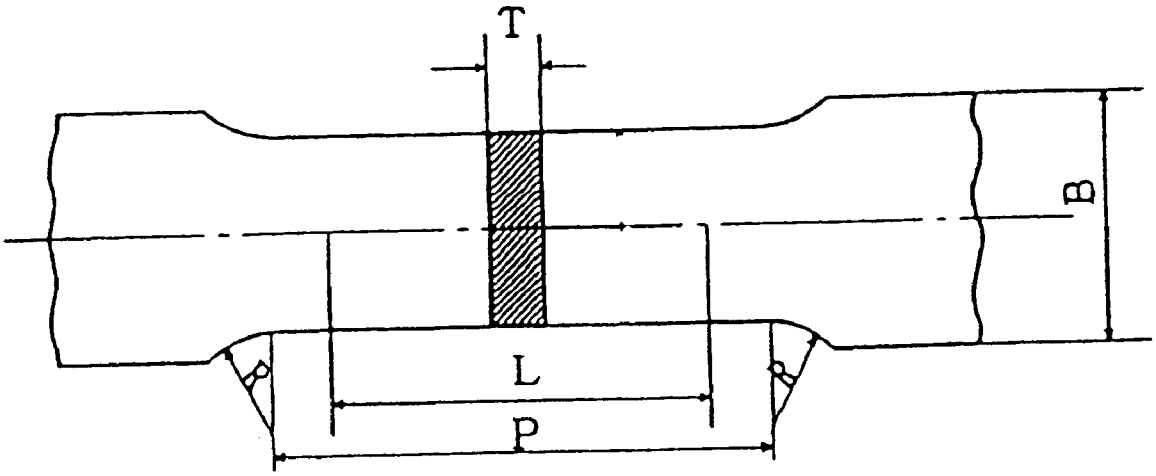
FIG. 2 is an illustration showing a shape of a test piece used for a tensile test of an iron-based alloy used for a shadow mask for a Braun tube according to the present invention.

Referring to FIG. 1, showing a color Braun tube 11 provided with a shadow mask 1 of the present invention, the shadow mask 1 is composed of an iron-based alloy plate 2 of a low thermal expansion coefficient containing nickel and cobalt. The iron-based alloy plate 2 has characteristic features of: crystal grain size of more than 6.0 and less than 9.0 measured in accordance with, a grain (particle) size analysis method prescribed by JIS (Japanese Industrial Standard) G0551; and 0.2% proof-(proof) stress of more than 240N/$mm^2$ and less than 320N/$mm^2$. Furthermore, it is preferred for the iron-based alloy plate 2 to have the maximum value of degree of integration of the respective crystal faces measured by an X-ray diffraction method of 20%.

The iron-based alloy plate is a low thermal expansion coefficient plate member which can achieve the object of the present invention mentioned hereinbefore. The term "low thermal expansion coefficient plate member" referred to herein is a plate member having a small thermal expansion coefficient, and in the present invention, there is used an iron-based alloy plate containing at least nickel of 31.0–38.0 weight % and cobalt of 1.0–6.5 weight %. Further, it is to be noted that a symbol "%" used herein means "weight %", which may be substituted with "mass %". Still furthermore, in consideration of an elastic coefficient, the preferred range of these components are nickel of 31.5–32.5 weight % and cobalt of 4.5–5.5 weight %. The thermal expansion coefficient of the iron-based alloy plate having the above element ranges is approximately of $0.4\times10^{-6}$/° C. In a case of nickel content of less than 31.0 weight % and more than 38.0 weight %, the thermal expansion coefficient becomes somewhat large. As a result, the thermal expansion is liable to be caused due to heat generated through collision of electron beam, which will lead to a fear that position of small holes formed to the iron-based alloy plate is shifted or displaced or shape thereof is deformed. On the other hand, in a case of cobalt content of less than 1.0 weight % and more than 6.5 weight %, the thermal expansion coefficient also becomes somewhat large, and as a result, the thermal expansion is liable to be caused due to heat generated through the collision of electron beam, which will lead to a fear that position of small holes formed to the iron-based alloy plate is shifted or displaced or shape thereof is deformed. The iron-based alloy plate further contains an inevitable impurity which is mixed during a plate member manufacturing process. Furthermore, the iron-based alloy plate of the present invention may optionally contain chromium, manganese, silicate, carbon and so on, which may be added for the purpose of achieving or realizing deoxidization function, forging ability and other functions of raw materials, as far as they have weight % range suitable for achieving the object of the present invention.

The iron-based alloy plate of the characters mentioned above is manufactured in the following manner.

First, metal materials are mixed so as to provide a predetermined component compositions and then dissolved and produced as a steel ingot. The thus produced steel ingot is rolled so as to have a predetermined thickness through hot forging or hot rolling process, and thereafter, the iron-based alloy plate is produced through cold rolling, annealing or like process. The plate member thus produced is then subjected to an etching treatment to thereby manufacture a plate member for the shadow mask. This etching treatment is a method of coating a photo-resist on the plate member, drying the coated resist, exposing the resist by using a mask for opening (aperture) formation having a predetermined opening (aperture) pattern and, thereafter, dissolving the resist by using an etching treatment agent to thereby form a predetermined opening pattern. The thus obtained iron-based alloy plate is used as an original plate for the shadow mask, which has characteristic features mentioned hereinlater. For this reason, there is no need for performing the annealing treatment that has been performed in the prior art and the shadow mask of the present invention can be manufactured through the press molding process.

The iron-based alloy plate has crystal grain size of more than 6.0 and less than 9.0, and preferably, of more than 7.5 and less than 8.5. This crystal grain size is represented by an austenite crystal grain size measured by a grain size measuring method prescribed by JIS G0551 (ASTM E112). The iron-based alloy plate having the crystal grain size of the range mentioned above is excellent in press-moldability, so that it is not necessary to perform the annealing treatment which has been performed in the prior art. In the case of the crystal grain size of less than 6.0, the grain diameter is made large, and hence, there is a fear of being insufficient in the strength after the press-molding, and on the other hand, in the case of the crystal grain size of more than 9.0, the grain diameter is made small, and hence, the iron-based alloy plate increases in its rigidity, which provides a bad press-moldability. Further, the crystal grain size of the iron-based alloy plate can be set and controlled to be within the predetermined range mentioned above by combining the draft in the rolling process and the thermal treatment condition in the annealing process in all the processes of manufacturing the iron-based alloy plate.

Furthermore, the iron-based alloy plate has its 0.2% proof stress of more than 240N/$mm^2$ and less than 320N/$mm^2$, preferably, more than 270N/$mm^2$ and less than 300N/$mm^2$, in which the 0.2% proof stress is measured by the metal material testing method prescribed in JIS Z2241 (ISO 6892) and is expressed as a stress at a time of extending a test material by 0.2%. This 0.2% proof stress is usually. utilized as a rule of thumb for sectioning an elastic deformation area of a material and a plastic deformation area thereof, and a material having a large 0.2% proof stress is hardly plastically deformed and is elastically deformable, whereas a material having a small 0.2% proof stress is liable to be plastically deformed.

In the present invention, by setting the 0.2% proof stress to the range mentioned above, the spring back caused at the time of the press-molding can be made small and the stability in dimension of the shadow mask after the press-molding can be achieved. As a result, the image display quality of the Braun tube provided with such shadow mask can be further improved.

In the case of the 0.2% proof stress being less than 240N/$mm^2$, the elastic deformation is hardly caused and the plastic deformation is liable to be caused, so that the generation of the spring back phenomena can be suppressed to thereby easily perform the press-molding. However, there is a fear of causing the deformation by the vibration due to the insufficient strength after the press-molding. On the other hand, in the case of the 0.2% proof stress being more than 320N/$mm^2$, the elastic deformation is liable to be caused and the plastic deformation is hardly caused, so that there is a fear of causing a large spring back at the time of press-molding. Further, the 0.2% proof stress can be also set and controlled to be within the range mentioned above by the method similar to the case of the crystal grain mentioned above.

Still furthermore, it is preferred for the iron-based alloy plate that a degree of integration of each of crystal faces measured by an X-ray diffraction method has the maximum value of 20%. The degree of integration of each of the crystal faces is represented by a ratio (%) of peak strength of a specified crystal face (hkl) with respect to the sum of peak strengths of the respective crystal faces (hkl) measured through the X-ray diffraction method. With the iron-based alloy plate used for the present invention, the crystal faces such as (111), (200), (220), (311), (331), (420), (422), etc. appear as main (important) diffraction peak.

In the present invention, by setting the degree of integration of the respective crystal faces of the iron-based alloy plate in a range mentioned above, the anisotropy of the orientation of the crystal face is made small, so that the anisotropy with respect to the plastic deformability at the press-molding process can be suppressed as much as possible. As a result, a shadow mask excellent in the dimensional stability, and the image display quality of a Braun tube provided with such shadow mask can be further improved.

In the case of the maximum value of the degree of integration being more than 20%, the anisotropy appears to the orientation of the crystal face, so that the anisotropy is caused to the plastic deformability, and hence, there may cause a fear that the shadow mask cannot be press-molded with a shape having a desired dimension. Further, with the degree of integration of each of the crystal faces of the iron-based alloy plate, it may be set and controlled to be within the predetermined ranges mentioned hereinbefore by the method similar to the case of the crystal grain and the 0.2% proof stress mentioned above, and particularly, the degree of integration can be easily controlled through the treatment at a temperature of more than 850° C. at the time of the annealing process. As far as such condition be maintained, a difference between the degrees of integration of the respective crystal faces is less than 20% and never over 20%.

EXAMPLE

The present invention will be more clearly understood from the following descriptions made with reference to the following Examples and Comparative Examples.

Examples 1 to 4

In order to prepare an iron-based alloy plate containing Ni (32.0 weight %), Co (5.0 weight %), Si (0.01 weight %), Mn (0.25 weight %), P (0.003 weight %), S (0.001 weight %), C (0.002 weight %) and residue of iron and impurity, metal materials of amounts corresponding to the above contents were dissolved, forged and hot-rolled, and thereafter, subjected to cold rolling and annealing processes, which were repeatedly performed. In this manner, plate members having a thickness of 0.13 mm were produced.

In the next step, a water-soluble casein resist was coated on both surfaces of the thus obtained plate member and then dried to thereby form resist films. Thereafter, a light is exposed to the resist films by using a glass dry plate as mask having a predetermined opening pattern for forming a pair of openings to thereby perform a patterning. After the hardening treatment and the baking treatment, ferric chloride solution as an etching solution having a temperature of 6° C. and a specific gravity of 48°. Be (heavy-Baume degree) was sprayed to the patterned resist films formed to both the surfaces of the iron-based alloy plate member so as to conduct etching work to the alloy plate member to form the predetermined opening patterns. After the washing process, resist films as residual were removed and then cleaned and dried to thereby prepare an iron-alloy plate as a plate member of the shadow mask.

Further, the crystal grain size (number), 0.2% proof stress, and the degree of integration of the respective iron-based alloy plates were adjusted or controlled in the following manner.

Example 1 was manufactured by a cold rolling process including primary rolling, intermediate rolling and final rolling steps and, thereafter, by an annealing process. Example 2 was manufactured by the similar manner to that of Example 1, but in Example 2, annealing temperatures after the intermediate rolling step and the final rolling step were lowered by 50° C. with respect to Example 1. Example 3 was manufactured by the similar manner to that of Example 1, but in Example 3, an annealing temperature after the final rolling step was raised by 200° C. with respect to Example 1. Example 4 was manufactured by the similar manner to that of Example 1, but in Example 4, a draft at the final rolling step was lowered by 5% and an annealing temperature after the final rolling step was raised by 200° C. with respect to the Example 1.

The tensile strength, the 0.2% proof stress and the expansion of each of the iron-based alloy plates of the above Examples 1 to 4 were measured in accordance with metal material test prescribed in JIS Z2241, and the crystal grain sizes (numbers) thereof were also measured in accordance with the grain size measurement prescribed in JIS G0551. In the measurement of the tensile strength, the 0.2% proof stress and the expansion, test pieces having shapes shown in FIG. 2 were used. Each of the test pieces has dimensions of gauge length L: 50 mm; parallel portion length P: 60 mm; shoulder portion radius R: 20 mm; thickness T: 0.13 mm (same as the thickness of the plate member) and grasping portion width B: 30 mm. The test results are shown in the following Table 1. Furthermore, peak strength (count value) of each of the crystal faces obtained through the X-ray diffraction method was measured, and in accordance with this measuring result, the degree of integration (%) of each of the crystal faces was calculated. The results are shown in the following Table 2. The degrees of storage of the crystal faces of Examples 3 and 4 were substantially the same as those of Examples 1 and 2, so that they are not shown in the Table 2.

Still furthermore, the iron-based alloy plates of Examples 1 to 4 were press-molded, without effecting the annealing process, by using a press-molding mold for a 17-inches color Braun tube at a temperature of 220° C. The thus prepared iron-based alloy plates were evaluated in their press-moldability. In the evaluation, it was judged that a product having a shape coincident with that of the mold exhibited a good press-moldability and that a product having a shape not coincident with that of the mold, a product of the plate deformed, for example, by the spring back and a product formed with cut-out portion were evaluated to have a defective press-moldability, which were hence judged not to be usable as shadow mask. These results are shown in Table 1.

Comparative Examples 1 to 4

Iron-based alloy plates were prepared in the manner substantially the same as those in the above Examples except the following points, and shadow masks were manufactured through the press-molding process. Thereafter, characteristics thereof were measured and the obtained results are shown in Table 1 and Table 2.

That is, the crystal grain size (number), 0.2% proof stress, and the degrees of integration of the respective iron-based alloy plates were adjusted or controlled in the following manner.

Comparative Example 1 was manufactured by changing working performance in the intermediate rolling step and the final rolling step in comparison with Example 1 mentioned above. Comparative Example 2 was manufactured by changing working performance in the intermediate rolling step and by lowering annealing temperatures, by 50° C., after the intermediate rolling step and after the final rolling step in comparison with Example 1 mentioned above. Comparative Example 3 was manufactured by further changing working performance in the intermediate rolling step and the final rolling step in comparison with Comparative Example 1. Comparative Example 4 was manufactured by changing annealing temperatures after the intermediate rolling step and after the final rolling step in comparison with Comparative Example 3. Further, the iron-based alloy plate of Comparative Example 2 exhibited the tensile strength of 650N/mm$^2$ and expansion of 2%, and accordingly, after the annealing process at a temperature of 810° C. for 20 minutes in a hydrogen containing nitrogen atmosphere furnace, a press-molding was performed.

TABLE 1

| | Tensile Strength (MPa) | 0.2% Proof Stress (MPa) | Crystal Grain Size | Press-Moldability |
|---|---|---|---|---|
| Ex. 1 | 460 | 300 | 8.5 | Good |
| Ex. 2 | 465 | 315 | 9.0 | Good |
| Ex. 3 | 426 | 243 | 6.5 | Good |
| Ex. 4 | 425 | 248 | 6.0 | Good |
| Co. Ex. 1 | 470 | 318 | 9.5 | Not Good |
| Co. Ex. 2 | 475 | 325 | 9.0 | Not Good |
| Co. Ex. 3 | 470 | 310 | 9.0 | Not Good |
| Co. Ex. 4 | 470 | 308 | 8.5 | Not Good |

Ex: Example, Co.Ex.: Comparative Example, N/mm$^2$ = MPa

TABLE 2

| | Degree of Integration of Crystal Faces (%) | | | | | | | Difference in Degree of |
|---|---|---|---|---|---|---|---|---|
| | (111) | (200) | (220) | (311) | (331) | (420) | (422) | Integration (%) |
| Ex. 1 | 12 | 16 | 15 | 16 | 14 | 14 | 13 | 4 |
| Ex. 2 | 11 | 17 | 16 | 16 | 13 | 14 | 13 | 6 |
| Co. Ex. 1 | 15 | 19 | 18 | 17 | 13 | 10 | 8 | 11 |
| Co Ex. 2 | 13 | 20 | 18 | 15 | 13 | 12 | 9 | 11 |
| Co. Ex. 3 | 12 | 38 | 12 | 11 | 10 | 9 | 8 | 30 |
| Co. Ex. 4 | 19 | 20 | 18 | 19 | 18 | 6 | 0 | 20 |

Ex: Example, Co.Ex.: Comparative Example

As mentioned hereinabove, according to the present invention, thermal expansion is hardly caused even by the generation of heat due to the collision of electron beams and, hence, there is less occur hole position shifting or hole shape deformation. Therefore, any position shifting or deviation of the electron beam reaching the fluorescent surface of the Braun tube is hardly caused, and hence, color shifting or unevenness of an image can be significantly prevented from causing. Further, the shadow mask manufactured by using such iron-based alloy plate is excellent in the press-moldability, and the generation of the spring back at the time of press-molding can be suppressed. Furthermore, since the anisotropy in the crystal face orientation can be made small, the anisotropy to the plastic deformability at the time of press-molding can be suppressed as much as possible. Still furthermore, since the annealing process may be eliminated, the improved manufacturing efficiency of the shadow mask can be achieved.

Accordingly, an improved manufacturing efficiency of the shadow mask can be achieved, and moreover, the image display quality of the Braun tube using such shadow mask can be further improved.

It is further noted that the present invention is not limited to the described embodiment and many other changes and modifications may be made without departing from the scope of the appended claims.

What is claimed is:

1. A shadow mask for a Brawn tube composed of an iron-based alloy plate of a low thermal expansion structure, wherein said iron-based alloy plate contains at least nickel of 31.0 to 38.0 weight % and cobalt of 1.0 to 6.5 weight %, and has a crystal grain size of more than 6.0 and less than 9.0 measured by a grain size measuring method prescribed in JIS (Japanese Industrial Standard) G0551, and 0.2% proof stress of more than 240 N/mm$^2$ and less than 320 N/mm$^2$.

2. A shadow mask for a Braun tube according to claim 1, wherein the crystal grain size of said iron-based alloy plate is preferably of more than 7.5 and less than 8.5 and the 0.2% proof stress thereof is preferably of more than 270N/mm$^2$ and less than 300N/mm$^2$.

3. A shadow mask for a Braun tube according to claim 1, wherein a maximum value of degree of integration of respective crystal faces of said iron-based alloy plate is of 20%, which is measured by an X-ray diffraction method.

4. A shadow mask for a Braun tube according to claim 1, wherein said iron-based alloy plate is press molded to a shadow mask without effecting annealing process.

5. A shadow mask for a Braun tube comprising:

a frame member;

a mask body in shape of plate made of an iron-based alloy material; and an opening portion formed to the mask body, wherein the iron-based alloy plate of a low thermal expansion structure containing nickel and cobalt, wherein the iron-based alloy plate has a crystal grain size of more than 6.0 and less than 9.0 measured by a grain size measuring method prescribed in JIS (Japanese Industrial Standard) G0551, and 0.2% proof stress of more than 240N/mm$^2$ and less than 320N/mm$^2$.

6. A shadow mask for a Brawn tube according to claim 1, wherein the range of the components in the iron-based alloy plate are nickel of 31.5 to 32.5 weight % and cobalt of 4.5 to 5.5 weight %.

* * * * *